US010295183B2

(12) United States Patent
Harmsworth

(10) Patent No.: US 10,295,183 B2
(45) Date of Patent: May 21, 2019

(54) WIND BOOSTED VENTILATORS HAVING OPENINGS AND COMPARTMENTS

(71) Applicants: Alice Rachel Bangera, Dubai (AE); Roland Habich Bangera, Dubai (AE)

(72) Inventor: Irwin Barrie Harmsworth, Dubai (AE)

(73) Assignees: Alice Rachel Bangera, Dubai (AE); Roland Habich Bangera, Dubai (AE)

( * ) Notice: Subject to any disclaimer, the term of this patent is extended or adjusted under 35 U.S.C. 154(b) by 239 days.

(21) Appl. No.: 15/150,719

(22) Filed: May 10, 2016

(65) Prior Publication Data

US 2017/0328565 A1 Nov. 16, 2017

(51) Int. Cl.
*F23L 17/02* (2006.01)
*F24F 13/26* (2006.01)
*F24F 7/02* (2006.01)

(52) U.S. Cl.
CPC ..... *F23L 17/02* (2013.01); *F24F 7/02* (2013.01); *F24F 13/26* (2013.01)

(58) Field of Classification Search
CPC .. F23L 17/02; F24F 13/20; F24F 13/26; F24F 7/02
USPC ..... 454/38, 1–37; 431/183
See application file for complete search history.

(56) References Cited

U.S. PATENT DOCUMENTS 1,849,812 A * 3/1932 Spencer ..... F23L 17/02 454/39
2,422,855 A * 6/1947 Rutter ..... F23L 17/02 454/37
3,115,820 A * 12/1963 Adelt ..... F23L 17/02 454/39
3,385,197 A * 5/1968 Greber ..... F23L 17/02 261/109
4,622,887 A * 11/1986 Peterson ..... F24F 7/02 285/382.2
5,359,788 A * 11/1994 Gell, Jr. ..... A23N 12/083 219/502
6,352,473 B1 * 3/2002 Clark ..... F23L 17/10 454/18
6,634,352 B2 * 10/2003 Maiello ..... F23J 13/04 126/307 R (Continued)

FOREIGN PATENT DOCUMENTS

WO WO 2014161029 A1 * 10/2014 ..... F24F 7/02

*Primary Examiner* — Vivek K Shirsat
(74) *Attorney, Agent, or Firm* — MH2 Technology Law Group, LLP

(57) ABSTRACT

There is provided a wind boosted ventilation apparatus for removing exhaust gases from inside enclosed spaces to the atmosphere, said ventilation apparatus comprising a ventilation duct and an external wall having a plurality of openings, a circular pressure plate placed on the top of said ventilation duct, a shroud surrounding said ventilation duct in a such way that a gap is defined between said ventilation duct and said shroud, and a plurality of guide vanes extending outwardly and transversally with respect to the central axis, wherein said openings are extending along said external wall of the ventilation duct and are inclined at a predetermined angle with respect to central axis of said ventilation duct, and said plurality of guide vanes are placed in a such way that they divide the area between the ventilation duct and the shroud into a plurality of compartments.

18 Claims, 5 Drawing Sheets

(56) References Cited

U.S. PATENT DOCUMENTS

| | | | | |
|---|---|---|---|---|
| 7,077,739 | B2 * | 7/2006 | Kupferberg | F23L 17/005 454/1 |
| 8,459,984 | B2 * | 6/2013 | Duesel, Jr. | F23G 7/08 431/202 |
| 2006/0040223 | A1 * | 2/2006 | Ghani | F23C 3/008 431/9 |
| 2008/0119128 | A1 * | 5/2008 | Demster | F24F 7/10 454/289 |
| 2008/0207105 | A1 * | 8/2008 | Huta | F23L 17/02 454/4 |
| 2009/0088060 | A1 * | 4/2009 | Arnold, Jr. | B01D 53/864 454/4 |
| 2013/0011239 | A1 * | 1/2013 | Khalitov | F04D 17/06 415/119 |
| 2016/0053997 | A1 * | 2/2016 | Hasegawa | F23L 17/02 126/307 R |

* cited by examiner

WIND BOOSTED VENTILATORS HAVING OPENINGS AND COMPARTMENTS

FIELD OF THE INVENTION

The present invention is related to a roof mounted wind boosted static ventilator for removing exhaust gases from enclosed spaces to the atmosphere, the ventilator comprising a ventilation duct having openings that are slightly inclined at a predetermined angle with respect to the vertical axis of said ventilation duct, a shroud surrounding said ventilation duct and guide vanes. The guide vanes act as physical barrier and divide the area between the shroud and the ventilation duct into a plurality of compartments having equal number of said openings, wherein the pressure gradient boosts the flow of exhaust gases out of the buildings.

BACKGROUND OF THE INVENTION

Systems using natural ventilation are already known as it dates back to as old as the Neolithic period as evident from purpose-built ventilations in China found to be built at that time. It is only in the past 150 years that the mechanical ventilation has been used. Prior to that period, all enclosures and buildings were naturally ventilated. These mechanical systems used alongside natural ventilations are crude compared to modern systems used nowadays.

Modern buildings are very demanding in which all standards of health and comfort have to be met, provided that they satisfy low energy consumption and sustainability. Modern ventilation and air conditioning systems focus on the economic use of floor space and for maintaining the productivity of the occupants. But these are only limited to residential and office buildings. When it comes to big industries, factories and storage facilities, the only practical and economical solution is using natural ventilation systems.

Traditional Static integrated-building ventilation systems are bulky, ineffective and vulnerable to dust accumulation, birds and vermin infestation. Nowadays there is a build-up of rotary ventilators which uses the wind energy to rotate and expel the hot air. However, the actual performance falls to reach the expectations since the ventilation system functions on the basis of buoyancy effects rather than rotational effects, and is dependent on wind directions. Moreover, these rotating units have bearings in it which gets eroded, and worn out which further increases the maintenance cost.

WO 2014/161029 describes a static ventilator system that uses wind induction effects to remove exhaust gases from enclosed spaces. This ventilator equipment has vertical slots in its duct which is covered by a shroud using vertical hollow brackets. The main problem faced by using this ventilator system is that the pressure difference created by the wind over the windward side and the leeward side are equalized all inside the space between the duct and the shroud and thus it becomes ineffective for the removal of exhaust gases by induction.

To address these problems, several approaches have been disclosed before, but none was found satisfactory.

Therefore there is a need to provide an improved ventilation system to overcome all the above mentioned concerns.

SUMMARY OF THE INVENTION

It is an object of the present invention to provide a static ventilator apparatus able to withstand all the problems and limitations mentioned above. Said static ventilator apparatus is adapted to be mounted on the roof of the building or enclosed spaces.

As a first aspect of the present invention, there is provided a ventilation apparatus for removing exhaust gases from inside enclosed spaces to the atmosphere, said ventilation apparatus comprising:

- a ventilation duct having a hollow top, a hollow bottom and an external wall, the external wall having a plurality of openings,
- a circular pressure plate placed on the top of said ventilation duct,
- a shroud surrounding said ventilation duct in a such way that a gap is defined between said ventilation duct and said shroud, and
- a plurality of guide vanes extending outwardly and transversally with respect to the central axis between the external wall of said ventilation duct and the shroud, wherein:

said openings are extending along said external wall of the ventilation duct and are inclined at a predetermined angle with respect to central axis of said ventilation duct, and said plurality of guide vanes are placed in a such way that they divide the area between the ventilation duct and the shroud into a plurality of compartments.

In a further aspect of the present invention, the ventilation duct and the shroud have a cylindrical shape and are concentric with respect to each other.

In a still other preferred embodiment, the ventilation apparatus further comprises a covering plate located on the top of the shroud. Preferably, the covering plate has a plate diameter and the shroud has a shroud parameter, the plate diameter being smaller than the diameter of the shroud. More preferably, wherein the diameter ratio between the covering plate diameter with respect to the shroud diameter is within the range of 1.0:1.1 to 1.0:1.5; being most preferably, 1.0:1.2.

In another preferred embodiment of the present invention, the openings are inclined at an angle ranging from 10 to 30 degrees with respect to the central axis of the ventilation duct. Preferably, the openings are inclined at an angle of 17 degrees with respect to the central axis of the ventilation duct.

In a still other preferred embodiment of the present invention, the pressure plate, the ventilation duct and the shroud are coupled to the guide vanes in such way that said guide vanes give rigidity to the whole ventilation apparatus. Preferably, the shroud has a shroud top, a shroud bottom, a surrounding wall and a height between the top and the bottom of the shroud, wherein said guide vanes about the surrounding wall and extend vertically along the height of the shroud from the bottom until the top of the shroud and the covering plate, thereby forming the compartments having a height equivalent to the height of the shroud.

In another preferred embodiment of the present invention, the guide vanes are inclined at an angle ranging from 25 to 45 degrees with respect to the radial axis of the ventilation duct. Preferably, the guide vanes are inclined at an angle of 30 degrees with respect to the radial axis of the ventilation duct.

In a still preferred embodiment of the present invention, the openings are grouped in a plurality of groups, each group comprising a number of adjacent openings, where each compartment comprises a single group and an equal number of openings. Preferably, each group comprises from 6 to 12 openings. More preferably, each group comprises 9 openings.

In a still preferred embodiment of the present invention, the number of compartments ranges between 4 to 10 compartments, preferably, 6 compartments.

DETAILED DESCRIPTION OF THE INVENTION

The ventilation apparatus of the present invention exhibits improved performances by having superior air flow rates and therefore able to efficiently remove exhaust gases from the enclosures to the atmosphere using pressure gradient. The ventilation apparatus of the present invention is configured to be mounted on the roof of any building facilities.

Figure 1:
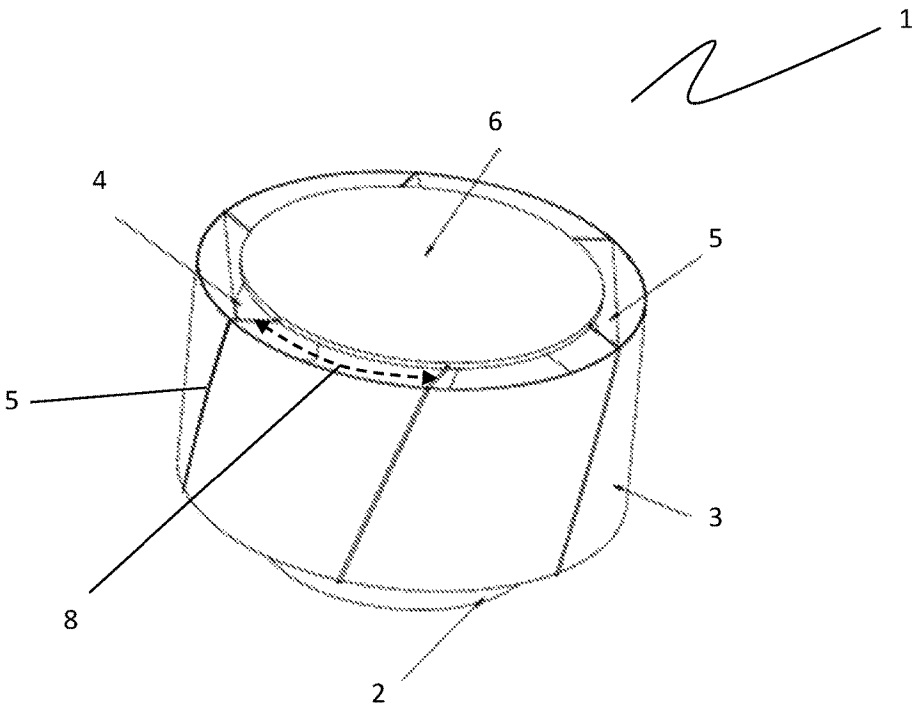
FIG. 1 illustrates an isometric view of the ventilation apparatus in accordance with an embodiment of the present invention.
Figure 2:
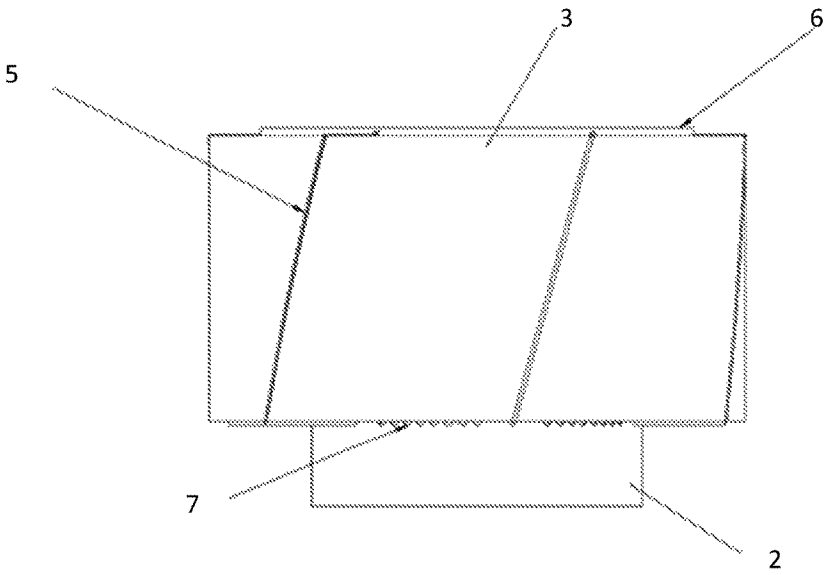
FIG. 2 illustrates a front view of the ventilation apparatus in accordance with an embodiment of the present invention.

As illustrated in FIGS. 1 and 2, the ventilation apparatus 1 comprises a ventilation duct 2 having a plurality of openings 7 (see also FIG. 4) and an outer shroud 3 surrounding said ventilation duct 2. Both ventilation duct 2 and shroud 3 have a cylindrical shape and are concentric with respect to each other.

Figure 5:
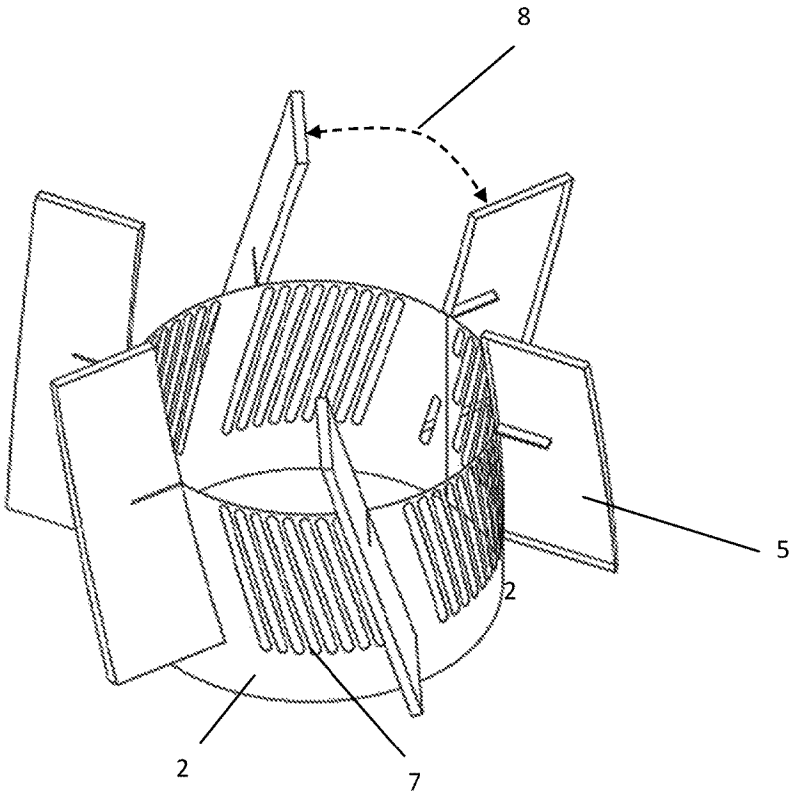
FIG. 5 illustrates a sectional view of the ventilation duct in accordance with an embodiment of the present invention

As illustrated in FIG. 5, the openings 7 are spaced around the circumference of the ventilation duct 2 and are inclined at a specific pre-determined angle with respect to the central axis of said ventilation duct. In a preferred embodiment the openings 7 are slightly inclined at an angle ranging from 10-30 degrees, preferably from 15-20 degrees with respect to the central axis of said ventilation duct. More preferably, the openings 7 are slightly inclined at an angle of 17 degrees with respect to the central axis of the ventilation duct. The plurality of openings 7 are preferably grouped into a number of openings wherein said groups of openings are spaced at a same distance around the circumference of the ventilation duct 2. The openings 7 placed in this way are adapted for accelerating and smoothing the flow of exhaust gases out of the ventilation apparatus 1. In a preferred embodiment of the present invention, the groups of openings comprise a number of openings ranging from 6 to 12 openings; preferably from 7 to 10 openings, being most preferably, each group comprises 9 openings.

The ventilation apparatus 1 further comprises a plurality of guide vanes 5 extending outwardly and transversally with respect to the central axis between the external wall of the ventilation duct 2 and the shroud. Said guide vanes 5 are placed between each adjacent group of openings. The implementation of the guide vanes 5, which is considered one of the preferred embodiments of the present invention, has a dual purpose. The guide vanes 5 act as physical barriers to the wind and divide the area inside the ventilation apparatus 1 into a plurality of compartments 8 (see FIGS. 4 and 5) which are used to retain the pressure gradient throughout the ventilation apparatus 1 in order to boost up the flow rate of exhaust gases out of the enclosures. The guide vanes 5 also act as streamlined body which helps the turbulent exhaust gases inside the enclosed space to flow over them smoothly by accelerating the conversion of turbulent flow into transitional flow, thereby reducing the turbulent viscosity and smoothing the flow of exhaust gases out through the ventilation duct 2. The guide vanes 5 not only help to remove exhaust gases out of the enclosed space, but also act as a support to provide rigidity to the entire ventilation equipment 1.

Figure 4:
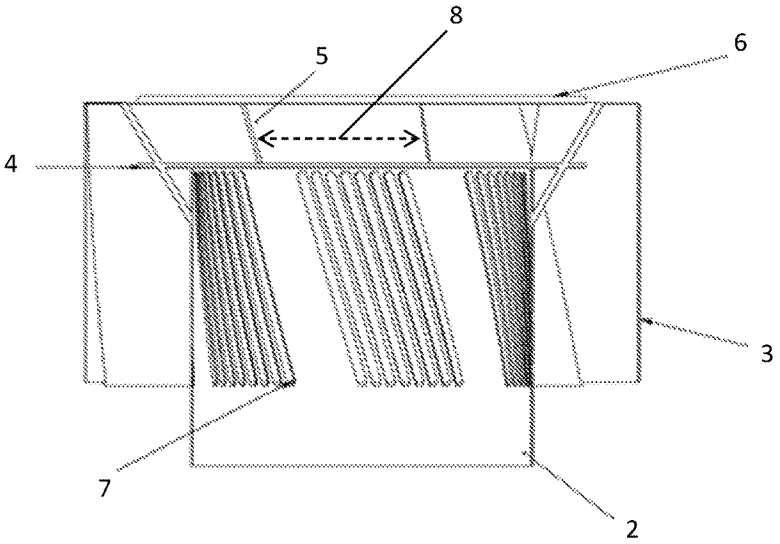
FIG. 4 illustrates a sectional view of the ventilation apparatus in accordance with an embodiment of the present invention.

The ventilation duct 2 is covered on the top by a pressure plate 4 which accelerates the air flow through the openings 5. FIG. 4 clearly illustrates said pressure plate 4.

Figure 3:
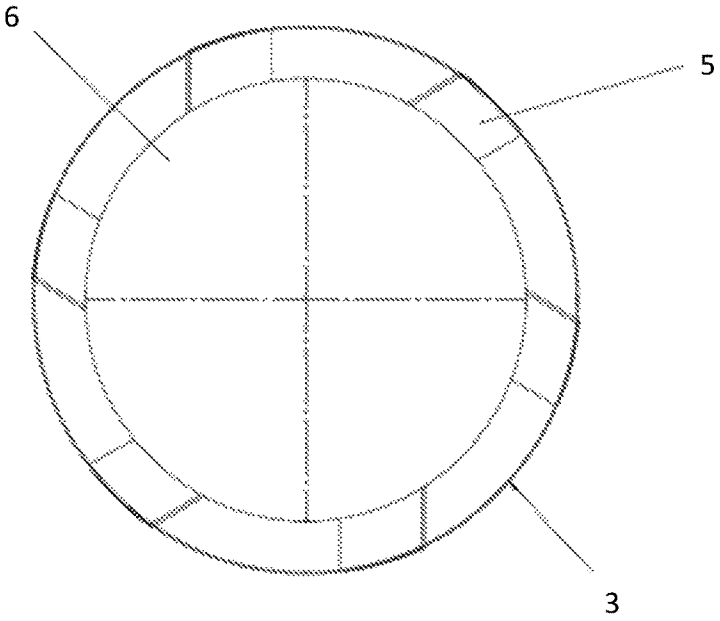
FIG. 3 illustrates a top view of the ventilation apparatus in accordance with an embodiment of the present invention.

On the top of the outer shroud 3, there is provided a covering plate 6. As illustrated in FIGS. 3 and 4, the covering plate 6 has a plate diameter which is smaller than the diameter of the shroud 3 so to prevent the entry of rainfalls from the sides in case of an ambient wind and to also prevent recirculation of the exhaust gases into the enclosed spaces below through these vents. In addition, the ratio of the diameter of the covering plate 6 with respect to the diameter of the shroud 3 has been selected in such way to allow the maximum air flow but not the entry of rain. The diameter ratio of the covering plate diameter 6 with respect to the shroud diameter is within the range of 1.0:1.1 to 1.0:1.5, preferably from 1.0:1.1 to 1.0:1.3, being most preferably 1.0:1.2.

The top of the shroud is preferably raised up to 30 mm in height to improve the wind induction effect and reduce the possibility of ingress from the rain.

As illustrated in FIG. 4, both pressure plate 4 and cover plate 6 are parallel with respect to each other.

The pressure plate 4, the ventilation duct 2 as well as the shroud 3 are supported by the guide vanes 5 which give rigidity to the whole ventilation apparatus 1. The guide vanes 5 have a dual purpose, not only they act as a support to the entire ventilation apparatus 1 but they also help in the flow of exhaust gases out of the ventilation unit 1.

In a preferred embodiment of the present invention, the guide vanes 5 have a concave surface on one end to fit into the outer shroud and a convex plane on the other end in order to support the ventilation duct 2.

The guide vanes 5 are inclined at an angle ranging from 25 to 45 degrees with respect to the radial axis of the ventilation duct, preferably at 30 degrees. The radial axis is an axis extending radially from the cylindrical wall of the ventilation duct perpendicularly to the central axis. The inclination of said guide vanes 5 helps to reduce the possibility of rain splashing into the flow stabilizer openings and smoothing the air flow path.

The guide vanes 5 also act as streamlined body which helps the turbulent exhaust gases inside the enclosed space to flow over them smoothly by accelerating the conversion of turbulent flow into transitional flow, thereby reducing the turbulent viscosity and smoothing the flow of exhaust gases out through the ventilation duct 2. The guide vanes 5 also help in retaining the pressure gradient in the area between the ventilation duct 2 and the shroud 3, by dividing the area into number of compartments 8, thereby not allowing the pressure gradient to normalize, which usually occurs in known static ventilation apparatus thereby decreasing their performance.

By the arrangement of the guide vanes 5 mentioned above, the overall performance of the ventilation apparatus 1 is increased, hence allowing a greater flow of exhaust gases through the ventilation duct 2 out of the buildings.

In a preferred embodiment of the present invention, the whole ventilation duct 2 is covered by a shroud 3 which forms the outermost part of the arrangement and also the one which faces wind. This part also has two significant purposes. The first and the most important one is the creation of a pressure gradient across the shroud 3. The wind produces a pressure gradient across the front and rear surfaces of the ventilation apparatus 1 in the line of wind by creating a low pressure wake on the leeward side.

The pressure gradient is used to remove exhaust gases from the enclosed space to the atmosphere. Said pressure gradient is retained throughout the process by using the guide vanes 5 as described above, i.e. by dividing the ventilator apparatus 1 into different compartments 8 as mentioned above.

The ventilation duct 2 comprises openings 7 that are slightly inclined at a pre-defined angle with respect to the central axis of said ventilation duct 2 and which forms the base of the ventilation apparatus 1 and facilitates the removal of exhaust gases through the same due to pressure gradient developed across the shroud 3. This pressure gradient is caused by the wind over the shroud 3 by creating a high pressure zone on the windward side and a low pressure wake zone on the downward side of the shroud 3.

The shroud 3 is also covered on the top by a covering plate 6 which is used to prevent entry of rainfall into the ventilation duct 2 and also to keep birds and vermin away. The covering plate 6 is also attached onto the guide vanes 5 which provide strength and rigidity to the entire ventilation apparatus 1. The wind airflow is maintained over said covering plate 6 thus preventing any recirculation of the exhaust gases from the air flow separated over the shroud 3.

FIG. 4 illustrates a sectional view of the ventilator apparatus 1 showing all parts in a detailed view. The compartments 8 created by the guide vanes 5 between the ventilation duct 2 and the shroud 3 can be seen clearly. It is between these compartments 8 that the pressure gradient created. As a result, a flow of air around the shroud 3 is retained and used to remove exhaust gases, thereby increasing the performance index of the entire ventilation apparatus 1 which has been tested practically under similar environment and thus has proven to be better than any other static ventilation equipment.

In a preferred embodiment of the present invention, the guide vanes 5 extends along the height of the shroud 3 from the bottom till the covering plate 6, thereby creating compartments 8 having the same height as the shroud 3.

In a still preferred embodiment of the present invention, and for improved pressure gradient created in the compartments 8, the guide vanes 5 should not have any openings and/or hollow in their surface.

As a conclusion, the ventilation apparatus 1 utilizes the compartments 8 created by the guide vanes 5 along with the ventilation duct 2 to retain the pressure gradient created as a result of local air flow pressure zones across the front and rear sides of the ventilation apparatus 1, i.e. the high pressure region created over the windward side and the low pressure wake region on towards the downward side. Said pressure gradient retained by the compartments 8 thus boosts up the movement of exhaust gases out of the enclosed space, thereby increasing the flow rate and improving the overall performance of the ventilation apparatus 1.

The Guide vanes 5 and the openings 7 improve the performance characteristics of the overall unit 1. Since there are no moving parts thereof, it is not susceptible for any mechanical wear and/or tear. Therefore the ventilation apparatus 1 of the present invention has shown to be capable of improving its performance with superior air flow rates than any other static or rotary ventilators.

While the invention has been made described in details and with reference to specific embodiments thereof, it will be apparent to one skilled in the art that various additions, omissions, and modifications can be made without departing from the spirit and scope thereof In particular, although the description has specified certain characteristics and parts that may be used in the apparatus of the present invention, those skilled in the art will appreciate that many modifications and substitutions may be made. Accordingly it intended that all such modifications, alterations, substitutions and additions be considered to fall within the spirit and scope of the invention.

The invention claimed is:

1. A ventilation apparatus for removing exhaust gases from inside enclosed spaces to the atmosphere, said ventilation apparatus comprising:

a ventilation duct having a hollow top, a hollow bottom and an external wall, the external wall having a plurality of openings, a circular pressure plate placed on the top of said ventilation duct, a shroud surrounding said ventilation duct in a such way that a gap is defined between said ventilation duct and said shroud, and a plurality of guide vanes configured to act as physical barriers to wind, extending outwardly and transversally with respect to a central axis between the external wall of said ventilation duct and the shroud, wherein:

said openings are extending along said external wall of the ventilation duct and are inclined at a predetermined angle with respect to a central axis of said ventilation duct, and said plurality of guide vanes are placed in a such way that they divide the area between the ventilation duct and the shroud into a plurality of compartments, which retain a pressure gradient throughout the ventilation apparatus, for boosting movement of the exhaust gases out of the enclosed spaces.

2. The ventilation apparatus according to claim 1, wherein the ventilation duct and the shroud have a cylindrical shape and are concentric with respect to each other.

3. The ventilation apparatus according to claim 1, wherein the ventilation apparatus further comprises a covering plate located on the top of the shroud.

4. The ventilation apparatus according to claim 3, wherein the covering plate has a plate diameter and the shroud has a shroud diameter, the plate diameter of the covering plate being smaller than the diameter of the shroud.

5. The ventilation apparatus according to claim 4, wherein the diameter ratio between the covering plate diameter with respect to the shroud diameter is within the range of 1.0:1.1 to 1.0:1.5.

6. The ventilation apparatus according to claim 5, wherein the diameter ratio between the covering plate diameter with respect to the shroud diameter is 1.0:1.2.

7. The ventilation apparatus according to claim 1, wherein the openings are inclined at an angle ranging from 10 to 30 degrees with respect to the central axis of the ventilation duct.

8. The ventilation apparatus according to claim 7, wherein the openings are inclined at an angle of 17 degrees with respect to the central axis of the ventilation duct.

9. The ventilation apparatus according to claim 1, wherein the pressure plate, the ventilation duct and the shroud are coupled to the guide vanes in such way that said guide vanes give rigidity to the whole ventilation apparatus.

10. The ventilation apparatus according to claim 1, wherein the shroud has a shroud top, a shroud bottom, a surrounding wall and a height between the top and the bottom of the shroud, wherein said guide vanes abut the surrounding wall and extend vertically along the height of the shroud from the bottom until the top of the shroud and the covering plate, thereby forming the compartments having a height equivalent to the height of the shroud.

11. The ventilation apparatus according to claim 1, wherein the guide vanes are inclined at an angle ranging from 25 to 45 degrees with respect to a radial axis of the ventilation duct.

12. The ventilation apparatus according to claim 11, wherein the guide vanes are inclined at an angle of 30 degrees with respect to the radial axis of the ventilation duct.

13. The ventilation apparatus according to claim 1, wherein the openings are grouped in a plurality of groups, each group comprising a number of adjacent openings, where each compartment comprises a single group and an equal number of openings.

14. The ventilation apparatus according to claim 13, wherein each group comprises from 6 to 12 openings.

15. The ventilation apparatus according to claim 14, wherein each group comprises 9 openings.

16. The ventilation apparatus according to claim 1, wherein the number of compartments ranges between 4 and 10 compartments.

17. The ventilation apparatus according to claim 16, wherein the number of compartments is 6.

18. The ventilation apparatus according to claim 1, wherein the surfaces of the guide vanes have no openings.

* * * * *